US006254099B1

(12) United States Patent
Pederson

(10) Patent No.: US 6,254,099 B1
(45) Date of Patent: Jul. 3, 2001

(54) PLAYING CARD WAR SIMULATION GAME

(76) Inventor: Mark Pederson, 36 Amity St., Staten Island, NY (US) 10305

( * ) Notice: Subject to any disclaimer, the term of this patent is extended or adjusted under 35 U.S.C. 154(b) by 0 days.

(21) Appl. No.: 09/305,403

(22) Filed: May 5, 1999

(51) Int. Cl.[7] ..... A63F 1/00
(52) U.S. Cl. ..... 273/292; 273/262; 273/308
(58) Field of Search ..... 273/236, 273, 273/255, 262, 292, 293, 296, 303, 308, FOR 292, FOR 255, FOR 262, FOR 308

(56) References Cited

U.S. PATENT DOCUMENTS 4,979,750 * 12/1990 Endrody .
5,090,707 * 2/1992 Patz .
5,112,059 * 5/1992 Mundle .
5,435,568 * 7/1995 Black .
5,810,359 * 9/1998 Wilkins .

* cited by examiner

*Primary Examiner*—Benjamine H. Layno
*Assistant Examiner*—Vishu K Mendiratta
(74) *Attorney, Agent, or Firm*—Goldstein Law Offices P.C.

(57) ABSTRACT

A war simulation card game, played by two players alternating turns, upon a game surface having two player sides, using two decks of cards—one associated with each player. Each player side has a weapon zone, an available resource pile and a depleted resource pile. The cards include weapons cards and resource cards. Cards are drawn from the deck into each player's hand—several initially and then one at the start of each turn. One resource card may be placed in the available resource pile per turn. The weapon cards each have resource requirements, attack specifications, and defense specifications. The player may take one of the weapon cards out of his hand and place it in the weapon zone if sufficient resources are present in the available resource pile to meet the resource requirements of that weapons card. The resources thus used are moved to the depleted resource pile. Weapons cards in the player's weapon zone confronting the opponent's weapon cards can selectively eliminate each other according to their respective attack specification and defense specification. Each turn the player moves the contents of the depleted resource pile into the available resource pile.

9 Claims, 2 Drawing Sheets

PLAYING CARD WAR SIMULATION GAME

BACKGROUND OF THE INVENTION

The invention relates to a playing card war simulation game. More particularly, the invention relates to an interactive card game played by two players wherein each player draws, holds, and deploys a series of cards from a card deck, each of which represents different facets of a military confrontation. Confrontation outcomes are determined according to the cards used by each of the players during game play.

Card based games have become increasingly popular. Spawned perhaps by the hundreds of games invented for the traditional 52 card deck, specialized games have been devised which use specialized card decks. However, in addition to the specialized card decks, many of these games also require further equipment or a pre-printed game board in order for game play to commence.

Typically these games are based upon fantasy situations. They employ imaginary places, monsters, magical weapons and imaginary creatures. Few games attempt to accurately simulate real world places, historical events, and real circumstances.

While these units may be suitable for the particular purpose employed, or for general use, they would not be as suitable for the purposes of the present invention as disclosed hereafter.

SUMMARY OF THE INVENTION

It is an object of the invention to produce a card game which simulates war-time confrontation, by employing elements which simulate the weapons, strengths, and economic power of nations at war.

It is another object of the invention to produce a card game which is challenging to play. Accordingly the game must be played according to various rules which challenge the player to carefully consider each move and make strategic decisions throughout game play.

It is further object of the invention that the ultimate path of the game is partially determined by the cards that the players draw from their card decks. Accordingly, each card may depict a particular land, air or sea weapon, a power level increase, or a funds level increase. The weapons are deployed according a player according to his the accumulated power and fund levels.

It is a still further object of the invention that each weapon has its own characteristics which determine its effectiveness against other weapons. Accordingly, each weapon has its own attack characteristics for determining success or failure when attacking the opponent's land, sea, or air weapons, and has its own defense characteristics which determine its success or failure in defending against attacks by the other player.

The invention is a war simulation card game, played by two players alternating turns, upon a game surface having two player sides, using two decks of cards—one associated with each player. Each player side has a weapon zone, an available resource pile and a depleted resource pile. The cards include weapons cards and resource cards. Cards are drawn from the deck into each player's hand—several initially and then one at the start of each turn. One resource card may be placed in the available resource pile per turn. The weapon cards each have resource requirements, attack specifications, and defense specifications. The player may take one of the weapon cards out of his hand and place it in the weapon zone if sufficient resources are present in the available resource pile to meet the resource requirements of that weapons card. The resources thus used are moved to the depleted resource pile. Weapons cards in the player's weapon zone confronting the opponent's weapon cards can selectively eliminate each other according to their respective attack specification and defense specification. Each turn the player moves the contents of the depleted resource pile into the available resource pile.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
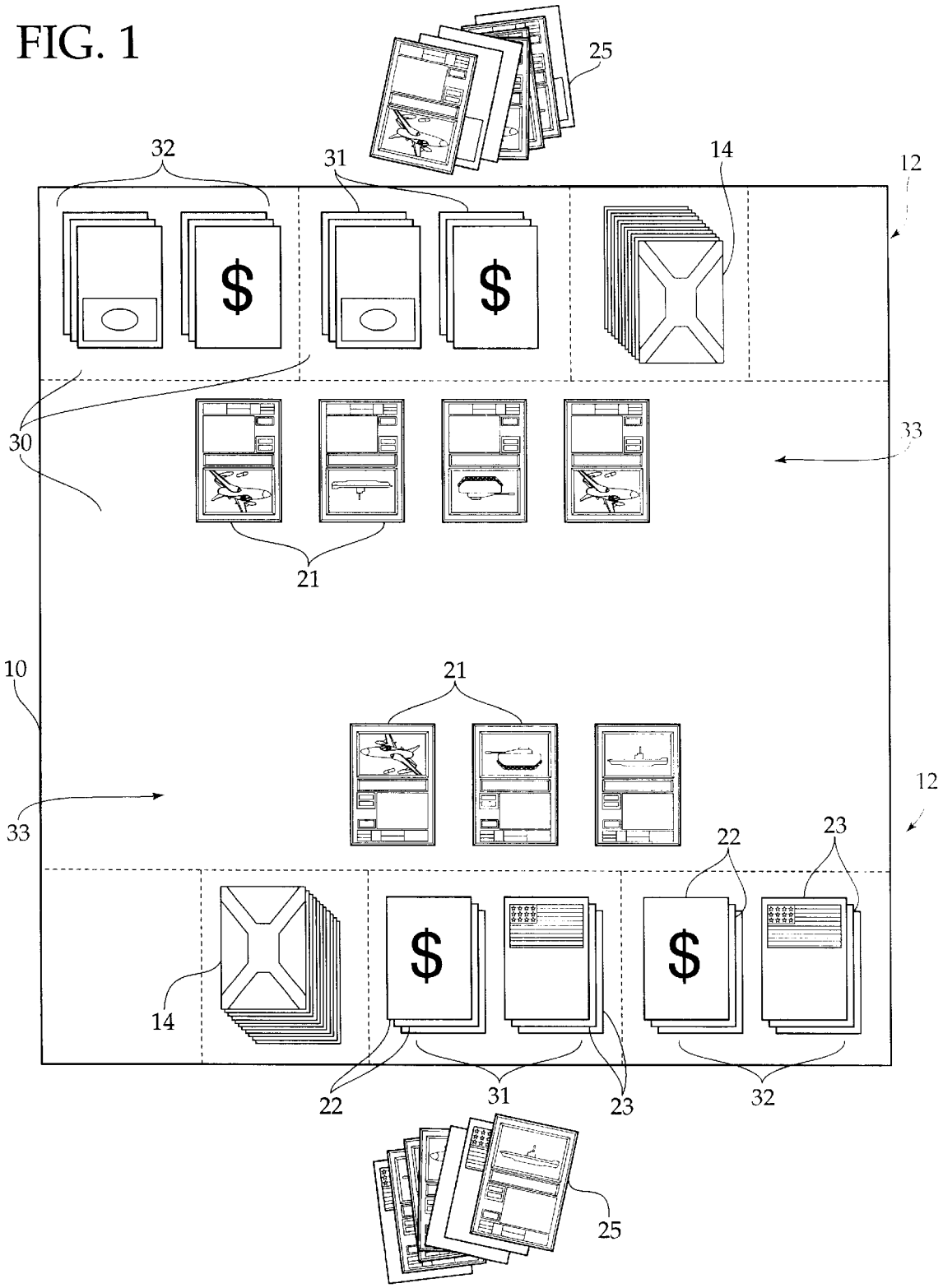
FIG. 1 is a top plan view, illustrating a game surface, showing a suggested layout for game play

FIG. 1 illustrates a game set up, recommended for playing the war simulation game, which may be created upon a horizontal game surface 10, such as a table. The game is played by two players—a first player and a second player, which alternate turns. Each player has a player side 12. The game is played using a pair of card decks 14—a first player deck is associated with the first player, and a second player deck is associated with the second player. Each card deck has a plurality of cards, which include weapon cards 21, fund cards 22, and power cards 23. The fund cards 22 and power cards 23 are also known as resource cards. Each player draws all of his cards from the deck 14 associated with that player.

Figure 2:
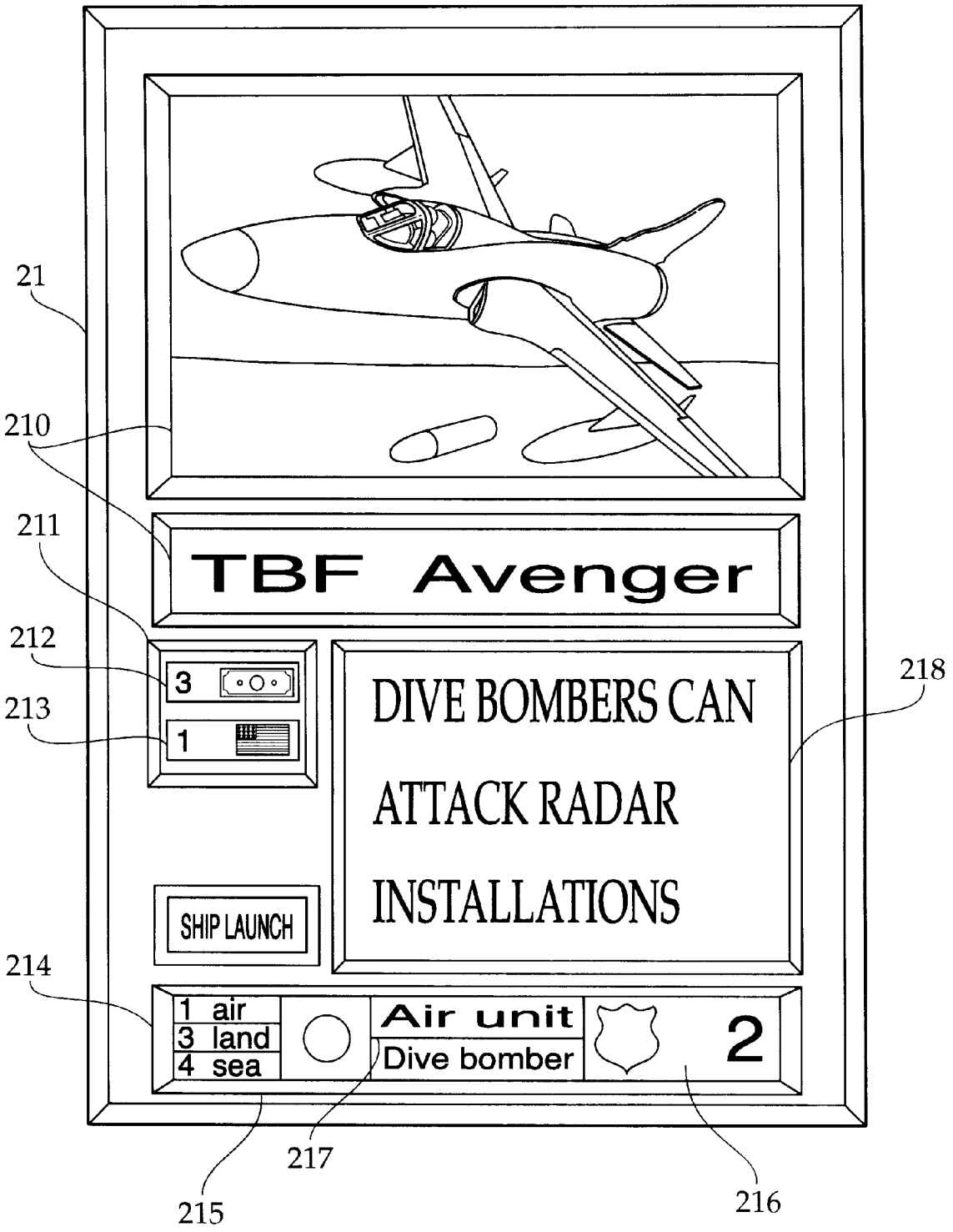
FIG. 2 is an enlarged top plan view, illustrating an exemplative weapon card and the various indicia printed thereon.

Referring momentarily to FIG. 2, one of the weapon cards 21 is depicted. The weapon card has card identification 210, comprises a picture and a verbal identification of the weapon; resource requirements 211, which includes a fund cost 212 and a power cost 213; unit specifications 214, which includes attack specifications 215 and defense specifications 216; and type indication 217, which indicates an air, land, or sea weapon. Other information may be provided on the card in a information section 218.

Each player initially draws several cards to create a player hand 25, which is preferably initially seven cards. When the cards in the player hand 25 are used, they are placed face-up on the game surface in one of several zones 30. Appropriate placement in one of the zones 30 is recommended to help keep game play organized.

Of greatest significance among card placement on the game surface, is the placement of cards in the available resource pile 31 or the depleted resource pile 32. The resource cards, i.e. the fund cards 22 and power cards 23 are placed in the available resource pile 31, and are moved to the depleted resource pile 32 as they are used to deploy weapon cards 33. During each turn, a player can place either a fund card 22 or a power card 23 in his available resource pile 31, to increase his available resource level, which is tabulated as the sum of all power cards and all fund cards.

The zones 30 include two player weapon zones 33—one associated with each player. The weapon cards 21 may be deployed by one of the players into that player's weapon zone 33. During their turn, the player can deploy one of more weapon cards 21 into the weapon zone 33. In order to deploy the weapon card 21, the player must have sufficient resources in the available resource pile 31 to satisfy the fund cost 212 and power cost 213 or that weapon card. The fund cards 22 and power cards 23 used to satisfy the fund cost 212 and power cost 213 are then moved to the depleted resource pile 32. If sufficient funds and resources still remain in the available resource pile 31, then additional weapon cards 21 can be deployed into the weapon zone 33 during that same turn.

The weapon cards 21 include air, land, and sea weapons as indicated by the type indication 217. Accordingly, the unit specifications 214 of each weapon card 21 includes air land and sea attack specifications 215. For Example, in the card illustrated in FIG. 2, the air specification is "1", the land specification is "2" and the sea specification is "4". The unit specification 214 also includes a defense specification 216, which is simply "2". These specifications indicate that weapons effectiveness against other weapon cards of the opponent. These specifications mean that this weapon card can defeat an air weapon card of the opponent having a defense value of less than one, a land weapon card having a defense value of less than two, and a sea weapon card having a defense value of less than four. Since this weapon card is an "air unit" as indicated by the type definition 217, this weapon card will be effective in defending against an attack from a weapon card of the opponent having an air attack specification of less than two.

When attacking the opponent, a relevant attack specification is determined by the type specification of the defending weapon card (i.e. the air attack specification is relevant against an air unit, the land attack specification is relevant against a land unit, etc.). The relevant attack specification of the attacking weapon card is compared to the defense specification of the defending weapon card. In order to survive an attack, the defending weapon must have a defense specification greater than the relevant attack specification. If both of these numbers are equal, the defending weapon will be destroyed. However, the attacking player must use caution, because if the defending weapon has a relevant attack specification greater than the attacking weapon's defense specification, then both weapon cards will be destroyed.

Game play commences by each player drawing the initial player hand 25 of seven cards from that player's card deck, as previously recited. Then, the players alternate turns. Each player turn starts by drawing one card from that player's deck and places it in the player hand 25. Then that player can take one resource card from the player hand and place it in their available resource pile 31. Then that player can take all the cards from the depleted resource pile 32 and place it in the available resource pile (at the start of the game, however, the depleted resource pile will be empty). Then the player can deploy weapon cards 21 from the player hand 25 into the weapon zone 33 according to the contents of the available resource pile 31, in the manner previously described. Then the player can return weapons back into the weapon zone 33 which were used to attack during the previous turn, but were not destroyed while attacking. Then the player can choose to attack the opponent using the weapons in the weapon zone 33. The opponent defends the attack with cards from his weapon zone 33. The outcome of these attacks are determined according to the attack specifications and defense specifications of the weapon cards, as previously described.

At the end of each turn, damage to each player can be tabulated in a variety of ways. The ultimate winner can also be determined in a variety of ways. For example, the winner might be determined by totaling the damaged weapons in a point-based system, or when one player eliminates all weapons in the weapon zone of the opponent. By a preferred method, each player has a "base" point value of thirty points. Any attack which cannot be defended by one of the players decreases the base point value for that player by the land specification of the attacking weapon. When the base point value for one of the players drops to zero, the opponent wins.

In conclusion, herein is presented a war simulation game which employs a plurality of cards which represent the weapons and resources of nations at war in order to allow the players to strategically deploy and utilize weapons in an interactive manner which simulates actual military conflict.

What is claimed is:

1. A war simulation game, played by two players upon a game surface having a first player side and a second player side, each player side divided into zones, including a weapon zone, an available resource pile, and a depleted resource pile, using two card decks, each card deck associated with a particular player, each card deck comprising a plurality of cards which include weapon cards and resource cards, each weapon card having resource requirements, attack specifications, and defense specifications, comprising the steps of:

drawing an initial card hand by each player from their card deck comprising a predetermined number of cards and then alternating turns between the two players, each turn comprising the steps of:

placing a resource card from the player hand in the available resource pile;

deploying a weapon card into the weapon zone from the player hand when sufficient resource cards are available in the available resource pile to meet the resource requirements of the weapon card while moving the resource cards used to meet the resource requirements into the depleted resource zone; and attacking the opponent such that the player has an attacking weapon from the player's weapon zone and the opponent has a defending weapon from the opponent's weapon zone, further comprising selectively eliminating at least one of the weapon cards by comparing the attack specifications of the attacking weapon card with the defense specifications of the defending weapon card.

2. The war simulation game as recited in claim 1, wherein each player turn further comprises the step of deploying a weapon card is preceded by moving the resource cards from the depleted resource pile to the available resource pile.

3. The war simulation game as recited in claim 2, wherein the resource cards further comprise fund cards and power cards, and wherein the resource requirements on each weapon card further comprise fund cost and power cost indicia which specify how many fund cards and power cards must be present in the available resource pile in order to deploy the weapon card.

4. The war simulation game as recited in claim 3, wherein weapon cards used by a player as an attacking weapon card cannot be used as a defending weapon card during the opponents turn immediately after the attacking weapon card is used.

5. The war simulation game as recited in claim 4, wherein each player turn begins by having the player draw one card from the player card deck and place the card thus drawn into the player hand.

6. The war simulation game as recited in claim 5, wherein each weapon card has a type indication which designates the weapon card as one of the group consisting of a land weapon, an air weapon, and a sea weapon; wherein the attack specification of each weapon card further comprises an air specification, a land specification, and a sea specification; and wherein the attack specification chosen for comparison from an attacking weapon card is matched to the type indication of the defending weapon card.

7. The war simulation game as recited in claim 6, wherein when eliminating at least one of the weapon cards by comparing the attack specifications of the attacking weapon card with the defense specifications of the defending weapon card, the defending weapon card is eliminated if the attack specification of the attacking weapon card is greater than or equal to the defense specification of the defending weapon card.

8. The war simulation game as recited in claim 7, wherein the step of eliminating at least one of the weapon cards further comprises:

comparing the defense specifications of the attacking weapon card with the attack specifications of the defending weapon card; and eliminating the attacking weapon card if the attack specification of the defending weapon card is greater than the defense specification of the attacking weapon card.

9. The war simulation game as recited in claim 8, wherein only one resource card may be removed from the player hand and placed in the available resource pile during any one player turn.

* * * * *